United States Patent [19]

Geis et al.

[11] 4,114,126

[45] Sep. 12, 1978

[54] SYSTEM FOR MOUNTING AN ARMATURE

[75] Inventors: David G. Geis, Chicago; Ingard B. Hodne, Northbrook, both of Ill.

[73] Assignee: Teletype Corporation, Skokie, Ill.

[21] Appl. No.: 816,823

[22] Filed: Jul. 18, 1977

[51] Int. Cl.[2] ..... H01F 7/08

[52] U.S. Cl. ..... 335/270; 335/276

[58] Field of Search ..... 335/270, 271, 273, 274, 335/276

[56] References Cited

U.S. PATENT DOCUMENTS

| | | | |
|---|---|---|---|
| 3,818,397 | 6/1974 | Roslin | 335/271 |
| 3,982,622 | 9/1976 | Bellino et al. | 335/276 X |

*Primary Examiner*—George Harris

*Attorney, Agent, or Firm*—W. G. Dosse; J. C. Albrecht

[57] ABSTRACT

An armature locating and holding structure in which the armature only partially overlaps one of the magnetic poles so as to produce a magnetic tensile force on the armature tending to pull the armature toward the partially overlapped pole and a magnetic gap tending to apply a rotational balance force so as to pull the armature structure toward a pair of stops that limit movement of the armature toward the partially overlapped pole and also limits the rotation of the armature by reason of the magnetic gap.

9 Claims, 3 Drawing Figures

SYSTEM FOR MOUNTING AN ARMATURE

FIELD OF THE INVENTION

The present invention relates to magnetic structures and more particularly to a system for locating, biasing, and holding an armature in place with respect to a magnetic structure.

BACKGROUND OF THE INVENTION

U.S. Pat. No. 3,982,622 granted on Sept. 28, 1976, to Joseph A. Bellino, et al. discloses an actuating mechanism for wire matrix printers. In the Bellino et al. patent a permanent magnet applies a magnetomotive force to a pair of pole structures for normally attracting an armature to the pole structure so as to apply bias to a torsion spring. An adjusting flag at the opposite ends of the torsion spring is mechanically located by an adjusting screw so as to control the amount of spring bias applied to the armature by the torsion spring.

In order to operate the print magnet, a coil is placed loosely around the armature. A pulse of current passing through the coil neutralizes the permanent magnet magnetomotive force in the armature, thus permitting the armature to respond to its spring bias and move away from the permanent magnetic pole structure. An extension on the armature engages the print wire and drives the print wire to impact the ribbon and paper of the printing device in order to print a dot. Simultaneous control of several of these magnets in a timed sequence successfully produces alphanumeric indicia on the paper.

SUMMARY OF THE INVENTION

The present invention relates to an improved system for mounting an armature on a magnetic structure having a permanent magnet with a first pole and a second pole for providing a magnetic bias for the system with a first pole structure in magnetic communication with the first magnetic pole and a second pole structure in communication with the second magnetic pole of the permanent magnet. An armature with an armature spring and means for biasing the armature spring is mounted in cooperation with the first pole structure and the second pole structure so as to provide a partial overlap of the armature at the first pole structure for producing a magnetic tensile force on the armature tending to pull the armature toward the first pole structure. A magnetic gap on the armature spring biasing means produces a magnetic tensile force tending to rotate the armature with respect to the poles. A pair of stops limit the movement of the armature both toward the partially overlapped pole and in a rotational mode.

Advantageously, the armature structure is held in place solely by the permanent magnet and is self-locating to eliminate critical location tolerances.

BRIEF DESCRIPTION OF THE DRAWINGS

A more complete understanding of the present invention may be had by referring to the following detailed description when considered in conjunction with the accompanying drawings wherein like reference numbers designate the same or similar parts throughout the several views in which.

DETAILED DESCRIPTION

Figure 1:
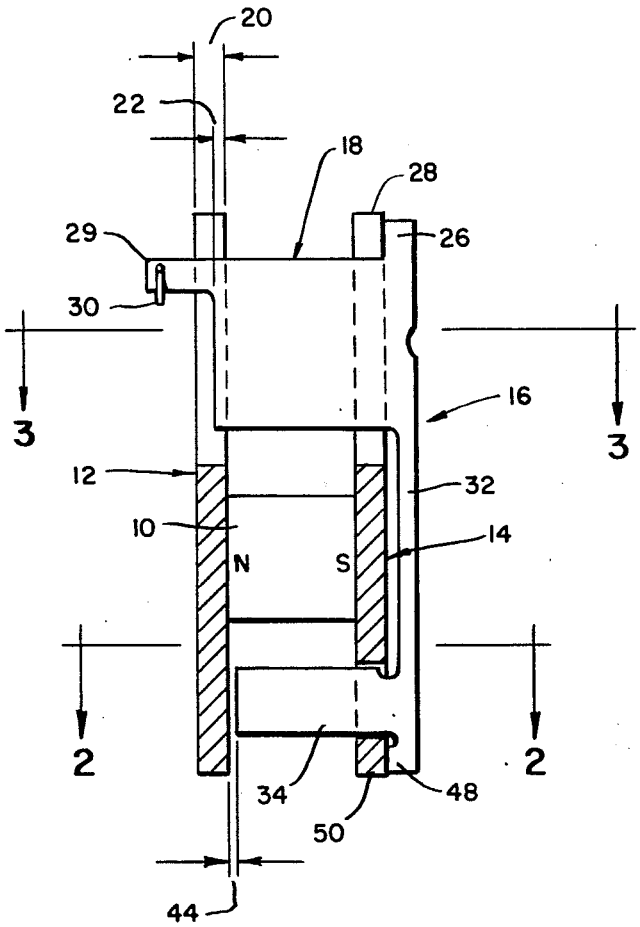
FIG. 1 shows an improved armature structure according to the present invention.

Referring now to the drawings and more particularly to FIG. 1, the permanent magnet 10 is positioned between and in intimate contact with a first pole structure 12 and a second pole structure 14. The pole structures 12 and 14 are formed plates of suitably-shaped magnetically-permeable material for use in a printing mechanism as shown in the abovementioned Bellino et al. patent. An armature structure 16 is associated with the magnetic structure fromed by the permanent magnet 10 and the first and second pole structures 12 and 14. The armature structure 16 comprises armature 18 which extends completely over a formed area of the second pole structure 14 and partly overlaps the first pole structure 12.

The first pole structure 12 is of a suitable width 20 for providing sufficient magnetic permeability to attract the armature 18 in the operation of the printing mechanism. However, the armature 18 extends only an overlapped distance 22 across the width 20 of the first pole structure 12. Consequently, the magnetic force resulting from the somewhat smaller overlap distance 22 tends to pull the armature 18 to the left, as viewed in FIG. 1, in order to maximize the overlapped distance 22 in order to minimize the reluctance of the magnetic path.

Figure 3:
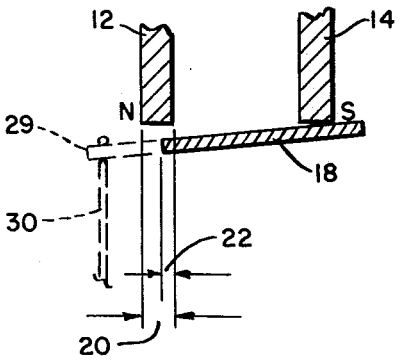
FIG. 3 is a cross-sectional view of the armature taken along lines 3—3 of FIG. 1.

Referring now to FIG. 3, the overlap distance 22 wherein a portion of the armature 18 extends over the first pole structure 12 is more clearly shown. The portion of the width 20 of the first pole structure 12 that is not covered by the overlap distance 22 experiences a higher magnetic reluctance, thereby tending to pull the armature 18 to the left so as to minimize the reluctance of the gap between the armature 18 and the first pole structure 12. The maximum overlap of the armature and the pole face will result in the minimum magnetic reluctance assuming a constant distance between the pole face and armature. A first stop ear 26 (FIG. 1) extends from the armature 18 and engages a portion 28 of the second pole structure 14 in order to limit leftward movement of the armature 18 under the attraction of the partial overlap distance 22.

An extension 29 on the armature 18 engages a print wire 30 and drives the print wire 30 to impact the ribbon and paper of the printing device (not shown) in order to print a dot.

A torsion spring 32 forms part of the armature structure and extends from the armature 18 to a flage 34 which is used to adjust the torque applied by the torsion spring 32 to the armature 18.

Figure 2:
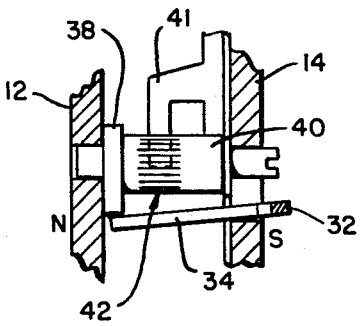
FIG. 2 is a cross-sectional view of the armature spring adjusting means taken along line 2—2 of FIG. 1 with the addition of an adjusting cam for controlling the amount of bias on the armature spring.

Referring now to FIGS. 1 and 2, the flag 34 is shown in FIG. 2 in engagement with a flag-adjusting plate cam 38. The cam 38 and its mechanism are not shown in FIG. 1 for clarity. The cam 38 is formed on a shank 40 which may be grooved or knurled. The shank 40 is suitably rotatably mounted at one end in the first pole structure 12, and at its other end the shank 40 is rotatably mounted in the second pole structure 14. Rotation of the shank 40 and the cam 38 by any suitable means such as a screwdriver blade or a hex wrench causes the plate cam 38 to rotate and thus move the flag 34 toward or away from the shank 40. Movement of the flag 34 by the plate cam 38 adjusts the torsional spring tension in the torsion spring 32. A detent 41 fixedly located with respect to the pole structure 14, engages grooves or knurl marks 42 on the shank 40 to keep the shank 40 and cam 38 from rotating undesirably.

A gap 44 is maintained between the flag 34 and the first pole structure 12. The purpose of the gap 44 is to generate a magnetic force on the flag 34 tending to pull the flag 34 to the left as shown in FIG. 1. This has a tendency to rotate the armature 18 clockwise. However, a second stop ear 48 formed near the flag 34 engages a portion 50 of the second pole structure 14 in order to limit leftward movement of the flag 34 and thus limit rotation of the armature 18.

In the operation of the structure illustrated in FIGS. 1, 2, and 3, the first stop ear 26 also serves as the pivot for the armature 18 about which the armature 18 rotates as it moves toward and away from the first pole structure 12 in the normal operation of the printing mechanism with which it is associated. Similarly, the second stop ear 48 serves as a pivot about which the flag 34 rotates as it is moved by the cam 38 in order to adjust the torsion supplied to the armature 18 by the torsion spring 32.

Although only one specific embodiment of the invention is shown in the drawings, and described in the foregoing specification, it will be understood that invention is not limited to the specific embodiment described, but is capable of modification and rearrangement and substitution of parts and elements without departing from the spirit of the invention.

What is claimed is:

1. An improved arrangement for mounting an armature on a magnetic structure having a source of magnetomotive force with a first magnetic pole and a second magnetic pole for providing a magnetic bias for the arrangement, a first pole structure in magnetic communication with the first magnetic pole, a second pole structure in communication with the second magnetic pole, an improved unitary armature structure including an armature spring and means for biasing the armature spring, wherein the improvement comprises:

a partial overlap of the armature and the first pole structure for producing a magnetic tensile force on the armature tending to pull the armature toward the first pole structure;

a first stop limiting movement of the armature toward the first pole structure;

a magnetic gap on the armature spring biasing means, the gap producing a magnetic tensile force tending to rotate the armature with respect to the pole structures; and a second stop limiting rotation of the armature against the magnetic tensile force acting on the armature spring biasing means.

2. An improved arrangement for mounting an armature according to claim 1 wherein the first stop comprises an ear on the armature structure, engaging the second pole structure.

3. An improved arrangement for mounting an armature in accordance with claim 2 wherein the ear comprises a pivot for the armature about which the armature rotates toward and away from the first pole structure.

4. An improved arrangement for mounting an armature according to claim 3 wherein the spring biasing means comprises a flag that is rotated with respect to the pole structure to bias the armature spring and wherein the gap exists between the flag and the first pole structure.

5. An improved arrangement for mounting an armature in accordance with claim 4 wherein the second stop comprises an ear on the flag structure for engaging the second pole structure.

6. An improved arrangement for mounting an armature according to claim 5 wherein the ear comprises a pivot of the flag about which the flag is rotated in order to bias the armature spring.

7. An improved arrangement for mounting an armature according to claim 1 wherein the spring biasing means comprises a flag that is rotated with respect to the pole structure to bias the armature spring and wherein the gap exists between the flag and the first pole structure.

8. An improved arrangement for mounting an armature according to claim 7 wherein the second stop comprises an ear on the flag structure for engaging the second pole structure.

9. An improved arrangement for mounting an armature according to claim 2 wherein the second stop comprises an ear on the flag structure for engaging the second pole structure.

* * * * *